US005137167A

United States Patent [19]

Ploeger

[11] Patent Number: 5,137,167

[45] Date of Patent: Aug. 11, 1992

[54] SEALING MEANS FOR FLOATING TANK ROOF AND METHOD OF INSTALLATION

[76] Inventor: Kurt E. Ploeger, 5025 Irving St., Beaumont, Tex. 77705

[21] Appl. No.: 596,522

[22] Filed: Oct. 12, 1990

[51] Int. Cl.[5] ..... B65D 88/46

[52] U.S. Cl. ..... 220/224; 220/220

[58] Field of Search ..... 220/216, 218, 219, 220, 220/221, 222, 224, 226, 227

[56] References Cited

U.S. PATENT DOCUMENTS

| | | | |
|---|---|---|---|
| 1,493,174 | 5/1924 | Wiggins | 220/224 |
| 1,660,021 | 2/1928 | Wiggins | 220/224 |
| 1,662,225 | 3/1928 | Wiggins | 220/284 |
| 1,900,904 | 3/1933 | Berger | 220/224 |
| 2,464,804 | 3/1949 | Goldsby et al. | 220/224 |
| 2,568,529 | 9/1951 | Wiggins | 220/222 |
| 2,600,237 | 6/1952 | Graham | 220/224 |
| 2,669,372 | 2/1954 | Allen et al. | 220/224 |
| 2,737,310 | 3/1956 | Ulm | 220/222 |
| 2,740,549 | 4/1956 | Graham et al. | 220/222 |
| 2,803,371 | 8/1957 | Edens | 220/224 |
| 2,855,122 | 10/1958 | Ulm et al. | 220/219 |
| 2,888,161 | 5/1959 | Springer | 220/224 |
| 2,897,998 | 8/1959 | Ulm | 220/224 |
| 4,126,243 | 11/1978 | Bruening | 220/224 |
| 4,162,022 | 7/1979 | Fox | 220/224 |
| 4,191,303 | 3/1980 | Kinghorn, Sr. et al. | 220/220 |
| 4,308,968 | 1/1982 | Thiltgen et al. | 220/222 |
| 4,353,477 | 10/1982 | Bruening | 220/224 |
| 4,437,577 | 3/1984 | Myers et al. | 220/224 |
| 4,457,446 | 7/1984 | Bruening | 220/224 |
| 4,540,104 | 9/1985 | Kawai et al. | 220/224 |
| 4,615,458 | 10/1986 | Grove et al. | 220/224 |
| 4,811,859 | 3/1989 | Kinghorn, Jr. | 220/224 |

FOREIGN PATENT DOCUMENTS

| | | | |
|---|---|---|---|
| 1269038 | 6/1961 | France | 220/222 |
| 177556 | 12/1961 | Sweden | 220/222 |
| 2146379 | 4/1985 | United Kingdom | 220/216 |

*Primary Examiner*—Stephen Marcus
*Assistant Examiner*—Stephen Cronin
*Attorney, Agent, or Firm*—Dodge, Bush, Moseley & Riddle

[57] ABSTRACT

A closure (38) for an annular clearance (36) between a floating tank roof (20) and a generally cylindrical tank (10) including the method of installation is provided. The closure (38) includes a plurality of arcuate shoes (40) mounted about the inner circumference of the tank (10) with variable length hanger rods (74, 75) connecting the shoes (40) for movement with the floating roof (20). A connecting expansion joint (84) connects spaced sides (42) of adjacent arcuate shoes (40) and includes a removable unit (95) of flexible material (100) which may be easily inserted and removed manually from the upper ends of retainer brackets (86) secured to the arcuate shoes (40) in a minimum of time while the tank (10) is in service. The expansion joints (84) may be easily disassembled for repair or maintenance of shoes (40) and associated components by removal of a cover (106) and removable connecting units (95).

8 Claims, 3 Drawing Sheets

FIG. 6
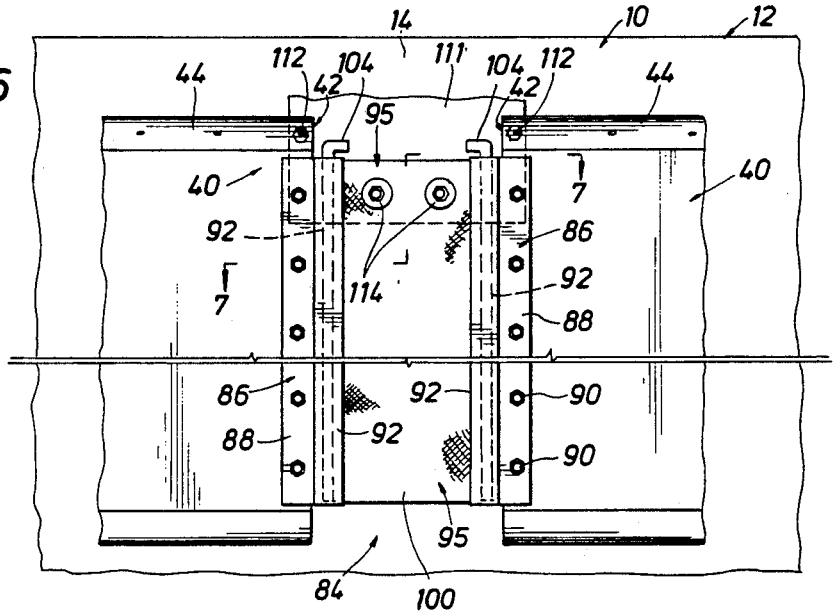
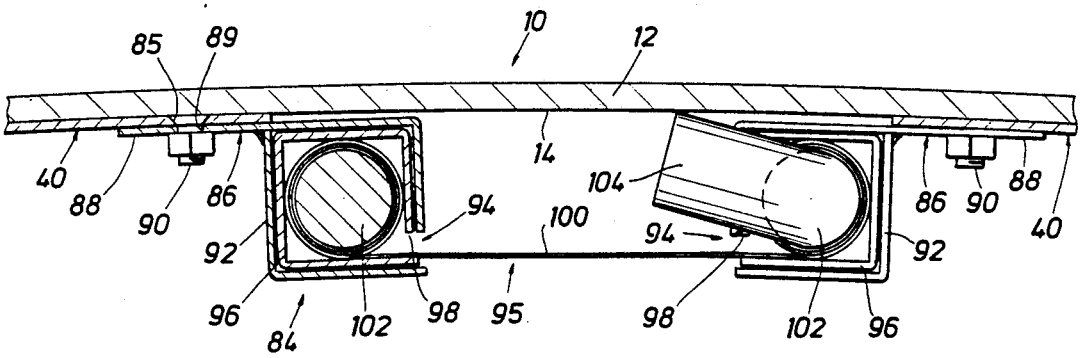
FIG. 7
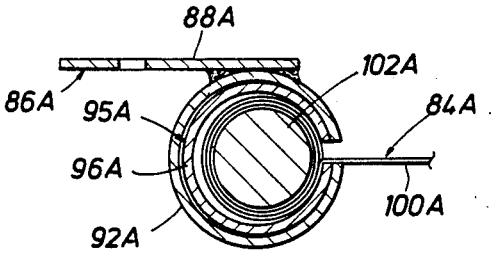
FIG. 8
FIG. 9
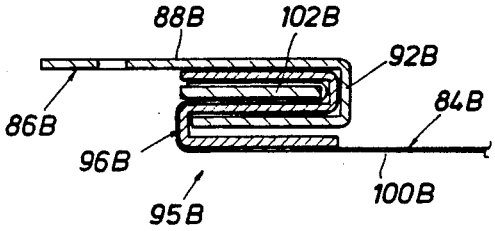

SEALING MEANS FOR FLOATING TANK ROOF AND METHOD OF INSTALLATION

BACKGROUND OF THE INVENTION

1. Field of the Invention

This invention relates to sealing means for a floating tank roof and a method of installing same, and more particularly to such a sealing means for covering the annular space between the floating roof and the tank while aiding in centering the roof on the liquid within the tank.

2. Description of the Prior Art

Heretofore, different sealing arrangements have been employed for covering the annular space between a floating roof and an associated cylindrical tank while aiding in centering the roof on the liquid within the tank. For example, U.S. Pat. No. 4,457,446 dated Jul. 3, 1984 shows a vertical cylindrical metal shoe adapted to slide vertically along the inner peripheral surface of the cylindrical tank with the shoe including a plurality of shoe segments or sections connected by vertically extending flexures. A flexible seal extends between the roof and the shoe to cover the annular space or clearance between the roof and the tank.

It has been common heretofore to connect such a metal shoe to a floating roof for vertical movement therewith. For example, U.S. Pat. No. 2,669,372 shows a floating roof with hangers secured between the floating roof and the shoe to effect vertical sliding movement of the shoe along the tank wall surface upon a corresponding vertical movement of the roof which may result from a change in the level of the liquid within the tank supporting the floating roof. Also, spring bands are provided between the floating roof and the shoe to force the shoe against the tank and the roof toward a centered position within the tank.

Other patents which show sealing means in an annular space between a floating roof and an associated tank include U.S. Pat. Nos. 1,665,163; 1,693,857; 1,900,904; and 4,162,022. However, the installation of sealing means heretofore positioned between a floating roof and a tank have been relatively complicated and time consuming, and many of such sealing means can not be installed while the tank is in service.

SUMMARY OF PRESENT INVENTION

The improved sealing means of the present invention for a floating tank roof can be installed in a minimum of time and while the tank is in service, regardless of the vertical position of the roof and the level of liquid product within the tank.

The sealing means employs matching standard bolt openings to permit the sealing means to be easily bolted onto the floating roof and onto a plurality of arcuate shoes mounted against the inner peripheral surface of the tank for vertical movement with the floating roof. The arcuate metal shoes are arranged in side to side spaced relation along a circular path against the inner surface of the tank, and a flexible removable expansion joint is provided between adjacent shoes. The expansion joint may be easily installed between adjacent shoes after the shoes have been placed in position against the inner surface of the tank.

One of the features of the present invention is the utilization of an expansion joint which may be removably connected to a pair of adjacent arcuate metal plates or shoes, and is easily installed for connection of adjacent shoes. The expansion joint includes a flexible material in the gap or space between opposed spaced sides of adjacent arcuate metal shoes and manually operable means to adjust the slack in the flexible material. Consequently, the sealing means can adapt to "out-of-roundness" for the tank shell or other dimensional variations encountered, such as might result from foundation settlement or high winds acting on the roof, for example.

The expansion joint includes opposed retaining brackets easily bolted onto standard bolt opening designs along the sides of adjacent arcuate metal shoes. Thus, the expansion joint may be easily removed for repair or maintenance of the sealing means.

The connecting expansion joint adapts itself for variations in the clearance or spacing of adjacent arcuate shoes and may be easily connected to the arcuate shoes after the arcuate shoes are positioned within the tank by insertion of rolled up flexible fabric material within the retaining brackets previously secured to the arcuate shoes.

It is an object of the present invention to provide an improved sealing means for positioning in the annular clearance between a floating roof and a cylindrical tank which may be installed in the tank while the tank is in service.

It is a further object of this invention to provide such an improved sealing means having a connecting expansion joint for installation between spaced adjacent arcuate shoes against the inner peripheral surface of the tank and adapted to compensate for varying clearances between the adjacent arcuate shoes.

It is another object of this invention to provide a method of installing the improved sealing means in which a connecting expansion joint may be easily positioned manually between adjacent shoes from a position above the shoes while the shoes are in place against the inner surface of the tank.

It is an additional object to provide a method of installation of a connecting expansion joint of the improved sealing means in which manually rotatable securing means are employed for adjusting the slack in a connecting fabric material for positioning between adjacent shoes and for insertion within suitable retaining brackets mounted on opposed sides of the arcuate shoes.

Other objects, features, and advantages of this invention will become more apparent after referring to the following specification and drawings.

BRIEF DESCRIPTION OF THE DRAWINGS

FIG. 6 is an enlarged front elevational view of the expansion joint extending between retaining brackets on adjacent arcuate shoes;

FIG. 7 is a section taken generally along the lines 7—7 of FIG. 6 showing the manually operable means for adjusting the slack in the flexible material of the connecting expansion joint positioned within the retaining brackets;

FIG. 8 is a cross sectional view of another embodiment of the connecting expansion joint showing a modified retaining bracket and manually operable means for adjusting the slack in the flexible material of the expansion joint; and FIG. 9 is a cross-sectional view of a further embodiment of the expansion joint of this invention in which a further retainer bracket and manually operable means for adjusting the slack of the flexible material of the expansion joint are illustrated.

DESCRIPTION OF THE INVENTION

Figure 1:
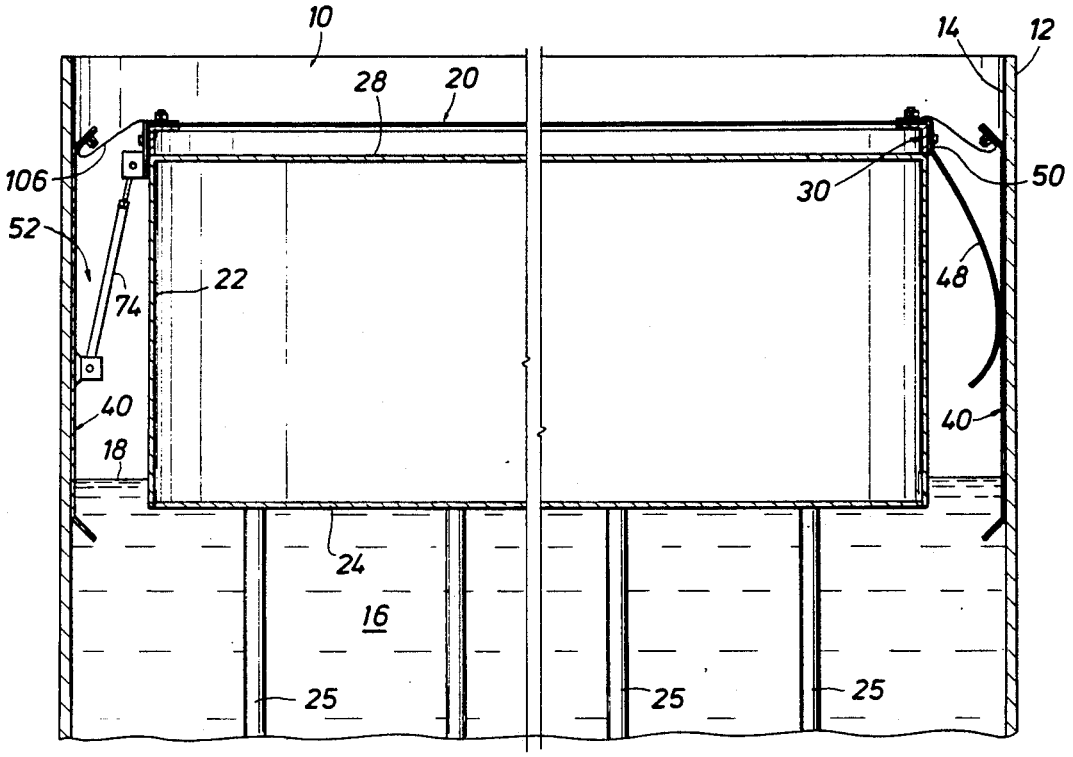
FIG. 1 is a cross-sectional view of the upper portion of a cylindrical tank showing a floating roof over a liquid hydrocarbon product in the tank with the improved sealing means comprising the present invention positioned in the annular space between the floating roof and the inner surface of the tank.

Referring now to the drawings for a better understanding of this invention, and more particularly to FIGS. 1-5, a liquid storage tank is generally indicated at 10 and is of a cylindrical shape having a tank wall 12 defining an inner peripheral surface 14. A liquid, such as gasoline or other liquid hydrocarbon product is shown within the tank at 16 and has an upper level 18.

Mounted within tank 10 and floating on liquid 16 is a floating roof generally indicated at 20. Roof 20 comprises a generally cylindrical rim 22 and a plurality of spaced lower portions closed by a lower horizontal plate 24. Suitable supporting legs 25 extend from plate 24 for supporting roof 20 when the liquid level reaches a predetermined low level. The upper end of roof 20 includes an upper horizontal plate 28 forming a deck for supporting workmen and equipment. Secured to the upper end of roof 20 and extending in a circular path thereabout is an angle (see FIGS. 1 and 3) generally indicated at 30 having a vertical leg 32 which forms a continuation of rim 22 and an inwardly extending horizontal leg or flange 34. Floating roof 20 is spaced from the adjacent inner peripheral surface 14 of tank 12 to form an annular space 36 therebetween.

The improved sealing means or closure forming this invention is mounted within the annular space or clearance 36 and is generally designated at 38. Sealing means 38 centers floating roof 20 within tank 10 and minimizes evaporation of liquid 16 from tank 10 while permitting a limited controlled amount of vapor from liquid 16 to be emitted into the atmosphere.

Figure 2:
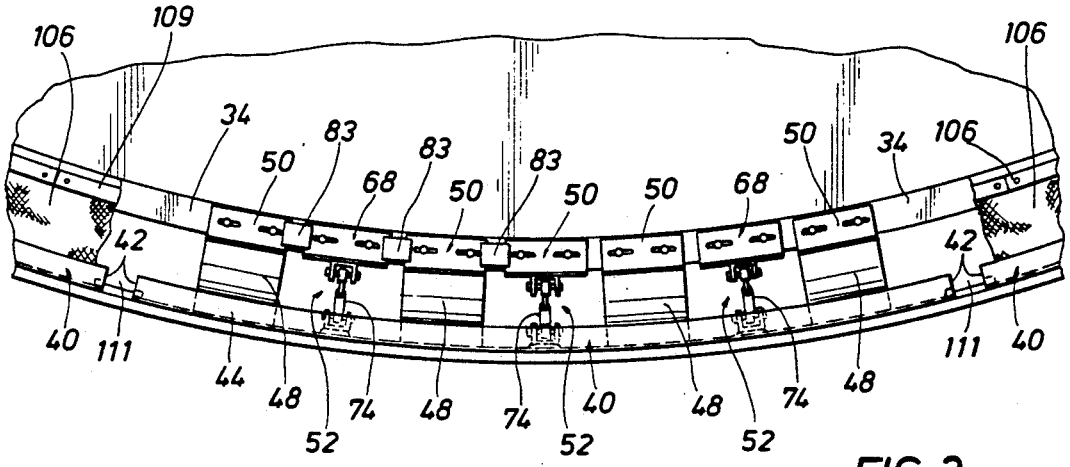
FIG. 2 is a top plan view of an arcuate portion of the tank and roof with the improved sealing means installed therebetween.

Sealing means 38 comprises a plurality of arcuate shoes or plates each indicated at 40 (as shown in FIG. 2) arranged in side to side spaced relation to each other along a circular path adjacent the inner peripheral surface 14 of tank 10. Each arcuate shoe 40 is a segment of a circle and is in contact with inner peripheral surface 14 of tank 10. Shoe 40 has a pair of opposed vertical extending sides 42. An inwardly extending inclined flange 44 (see FIG. 3) is provided along the upper edge of arcuate shoe 40 and a lower inwardly extending flange 46 is provided along the lower edge of arcuate shoe 40.

For urging shoes 40 against inner tank surface 14 and to urge roof 28 to a centered position within tank 10, a plurality of bowed steel spring bands 48 have angles 50 along their upper ends bolted to angles 30 of floating roof 20. Spring bands 48 thus are biased between floating roof 20 and shoes 40 thereby to urge floating roof 20 to a centered position and to urge shoes 40 against wall 12. As shown in FIG. 2, each shoe 40 has four spring bands 48.

Figure 3:
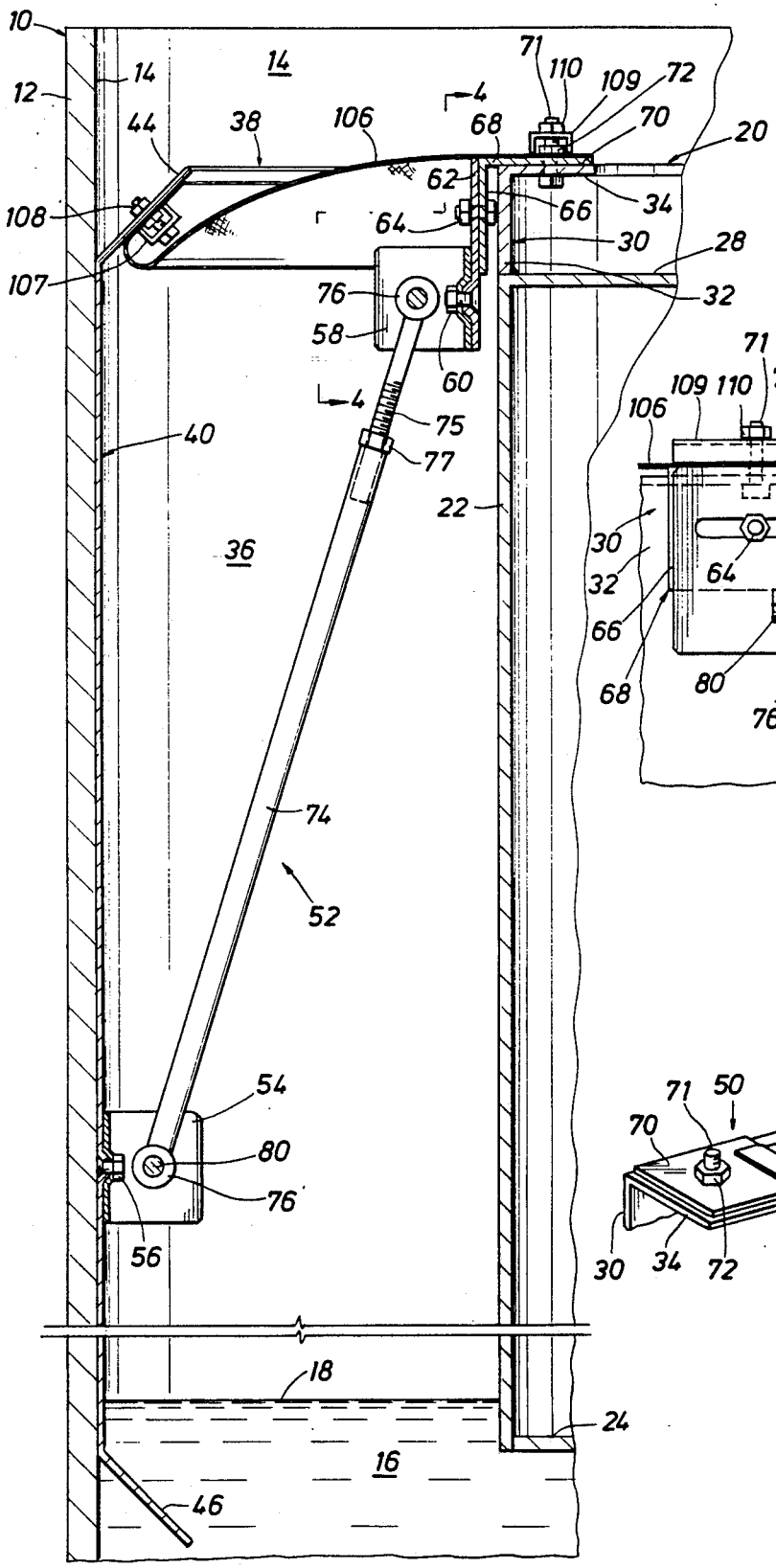
FIG. 3 is an enlarged fragment of FIG. 1 showing the improved sealing means connected between the roof and arcuate shoes fitting against the inner surface of the tank.
Figure 4:
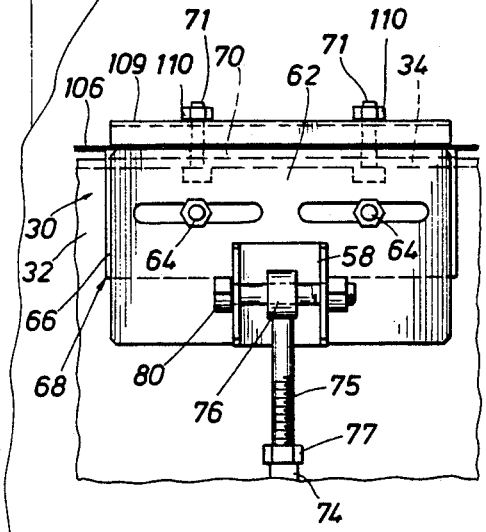
FIG. 4 is a view taken generally along line 4—4 of FIG. 3 and showing in front elevation the mounting of a hanger rod to the floating roof.
Figure 5:
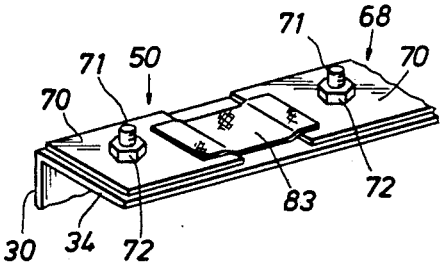
FIG. 5 is a perspective of adjacent spaced mounting angles on the floating roof and showing sealing means extending between the spacing of the mounting angles.

Arcuate shoes 40 are connected to floating roof 20 for vertical movement therewith. For this purpose, a plurality of hanger assemblies each indicated generally at 52 are mounted on angle 30 between spring bands 48 as shown in FIG. 2. Referring particularly to FIGS. 3-5, each hanger assembly 52 includes a U-shaped bracket 54 bolted at 56 to arcuate shoe 40. An upper U-shaped bracket 58 is bolted at 60 to vertical plate 62 which in turn is bolted by bolts 64 to a vertical leg 66 of an angle 68. Angle 68 has an upper horizontal leg 70 receiving and extended long length bolt 71 and a threaded nut 72 secures leg 70 to horizontal flange 34 of floating roof 20. Connected between U-shaped brackets 54 and 58 are a pair of telescoping hanger rods 74, 75 each having an eye 76 on one end. Outer telescoping rod 74 has a nut 77 secured thereon adapted to receive externally threaded inner rod 75 in threaded relation. Suitable bolt and nut combination 80 extend through eyes 76 for mounting hanger rods 74, 75 for pivotal movements.

Brackets 54 and 58 are first preassembled onto respective arcuate shoe 40 and floating roof 20 prior to positioning and adjustment of hanger rods 74, 75. Then, lower hanger rod 74 with nut 77 thereon is mounted on U-shaped bracket 54 for pivotal movement with bolt 80 being secured within eye 76. Next, inner rod 75 is threaded within nut 77 for adjustment of rod 75 to the desired length. Then, upper nut and bolt combination 80 is mounted through eye 76 for securing upper hanger rod 75 to bracket 58.

As shown in FIG. 5, a spacing or gap is formed between angle 50 and 68 mounted on horizontal flange 34 of roof 20. To minimize any leakage of vapors or liquid between angles 50 and 68, a suitable expanded polyurethane foam tape shown at 83 is mounted on the horizontal legs of angles 50, 68 to fill the gap therebetween.

After connection of hanger rods 74, 75 to arcuate shoes 40 and floating roof 20, spaced opposed sides 42 on adjacent shoes 40 form a gap or clearance therebetween which may vary depending on such factors as the "out-of-roundness" of the tank and manufacturing tolerances, for example. To connect shoes 40 to each other, a connecting expansion joint shown generally at 84 in FIGS. 6 and 7 is provided between each adjacent pair of arcuate shoes 40. A marginal portion of each shoe 40 at side 42 is provided with a plurality of spaced openings 85 (see FIG. 7). Expansion joint 84 includes a retaining bracket 86 mounted on each adjacent arcuate shoe 40. Each bracket 86 has a plate 88 with openings 89 aligned with openings 85 and bolted at 90 to shoe 40. An outer tubular member 92 of bracket 86 has a generally rectangular cross section and includes a longitudinal extending slot 94.

A manually insertable and removable connecting unit is shown at 95. It includes an inner telescoping member 96 with a longitudinally extending slot 98, and a flexible material 100 secured at opposite ends to manually rotatable rods 102 positioned within inner tubular members 96 and having out-turned ends 104.

Flexible material 100, such as a suitable fabric or plastic material, is rolled up on rods 102 to extend sufficiently to span the clearance between brackets 86 on adjacent shoes 40. When the desired width of flexible material 100 is obtained from manual rotation of rods 102, connecting unit 95 is first positioned over retaining brackets 92. Next, inner tubular members 96 are inserted within the open upper ends of outer tubular members 92 with flexible material 100 positioned within slots 94 and 98. Ends 104 engage the inner surface 14 of tank wall 12 to stop the unrolling of flexible material 100 after insertion.

It is to be noted that rods 102 will function satisfactorily without inner tubular members 96 and it may be desirable in many instances to omit members 96 with rods 102 and material 100 inserted directly within outer tubular members 92.

Next, referring particularly to FIGS. 3 and 4, a cover 106, such as a suitable fabric material, is positioned between floating roof 20 and arcuate shoes 40 to cover the annular clearance 36 between roof 20 and tank 10. A suitable metal support channel 107 clamps a marginal side portion of fabric material 106 by bolts 108 to upper flange 44 of arcuate shoes 40. The other marginal side portion of fabric material 106 is formed with openings to receive bolts 71 and nuts 72 on angles 68 and to receive similar nuts and bolts on angles 50. Then, the other marginal side portion is positioned over the nuts and bolts of angles 50, 68. A metal support channel 109 is fitted against the marginal side portion of fabric material 106 and receives bolts 71 extending from the horizontal leg 70 of angles 50 and 68. Then, additional nuts 110 clamp channels 109 and fabric material 106 against angles 50 and 68 for tightly securing fabric material 106. It is noted that a gap or spacing is provided between upper flanges 44 above connecting units 95 on adjacent shoes 40 after connecting units 95 are positioned. To minimize leakage of vapor at this position as shown particularly in FIG. 6, a fabric flap shown at 111 is secured to adjacent shoes 40 at 112, secured to fabric material 100 of connecting units 95 at 114, and similarly secured to fabric material 106 forming the annular cover. Fabric material 106 of annular shape covers hanger assemblies 52, spring bands 48, and the entire annular area 36 to complete the assembly of the improved sealing means 38 comprising the present invention.

As a preferred assembly of improved sealing means 38 with floating roof 20 supported on the upper level 18 of liquid 16 within tank 10 while the tank is in service, the disassembled parts of sealing means 38 are first positioned on deck 28 of roof 20. Around three arcuate shoes 40 each of a length of twelve (12) feet each are connected to each other by the insertion of connecting units 95 within retaining brackets 86 which have been previously bolted to shoes 40. Then, the three shoes 40 are lowered within the annular space 36 between roof 20 and tank wall 12. Next, angles 50 and spring bands 48 are bolted onto horizontal flange 34 of floating roof 20 for positioning of spring bands 48 and urging of shoes 40 against tank wall 20 and floating roof 20 to a centered position. Next, angles 68 with brackets 58 thereon are bolted to horizontal flange 34 of floating roof 20. Then, hanger rods 75 are adjusted on nuts 77 and are secured by nut and bolt combinations 80 to brackets 58.

In sequence, units of three shoes 40 are positioned in a similar manner about a circular path against the inner surface 14 of tank 10. The last unit of shoes 40 is adapted for the arcuate segment remaining between roof and tank. Then, connecting units 95 are inserted to connect the several shoe units together. If desired, connecting units 95 may be inserted upon positioning of each unit of shoes 40.

Next, cover 106 is secured by the bolting of channel 107 to flanges 44 and the bolting of channel 109 to the horizontal legs of angles 50 and 68. Thus, the improved sealing means 38 is assembled while the floating roof 20 is floating in a tank 10.

For subsequent maintenance or repair of sealing means 38, cover 106, or a portion of cover 106, may be first removed by a workman supported on deck 28 to provide access to the components to be repaired. Upon repair, cover 106 is replaced. Such maintenance and/or repair may be provided with floating roof 20 and tank 10 in service.

Referring now to FIG. 8, a modification of the connecting expansion joint is illustrated with the addition of the letter "A" to designate similar parts. outer tubular member 92A is secured to plate 88A of bracket 86A with inner tubular member 96A insertable within the upper open end of outer tubular member 92A. Tubular members 92A and 96A are of a circular cross-section and flexible material 100A is secured at one end to rotatable rod 102A which is mounted within inner tubular member 96A. A manually insertable and removable connecting unit 95A is provided by a pair of rods 102A having flexible material 100A secured at opposite ends to rods 102A, and a pair of inner tubular members 96A. Upon the adjustment of flexible material 100A on rods 102A, tubular members 96A are inserted within the open upper ends of outer tubular members 92A for connecting the adjacent pair of shoes 40.

A further embodiment of the connecting flexible joint is shown at 84B in FIG. 9 and includes a retaining bracket 86B for mounting on an arcuate shoe. Bracket 86B has a plate 88B with a U-shaped tubular member 92B secured thereon. The removable connecting unit 95B includes a Z-shaped inner member 96B adapted to receive a flat metal strip 102B about which flexible material 100B extends. Metal strip 102B, upon the positioning of flexible material 100B to the desired width, is then inserted within the Z-shaped inner member 96B thereby to anchor flexible material 100B. Then, unit 95B is inserted within the open upper end of retaining brackets 92B for positioning of expansion joint 84B.

From the above, it is apparent that an improved sealing means has been provided for a floating tank roof which can be installed in a minimum of time while the tank is in surface. The expansion joint 84 which connects adjacent sides of the arcuate shoes 40 includes a removable unit 95 which may be easily positioned within retainer brackets 86 for connecting the shoes.

While preferred embodiments of the present invention have been illustrated in detail, it is apparent that modifications and adaptations of the preferred embodiments would occur to those skilled in the art. However, it is to be expressly understood that such modifications and adaptations are in the spirit and scope of the present invention as set forth in the following claims.

What is claimed is:

1. In a cylindrical liquid storage tank (10) having a floating roof (20) with a cylindrical rim (22) thereabout; improved sealing means fitting between the circular rim of said roof and an inner peripheral surface (14) of said tank, said improved sealing means comprising:

a plurality of arcuate metal shoes (40) each having its side end (42) spaced from a side end (42) of an adjacent shoe, said shoes placed in a circular path in contact with the inner surface (14) of said tank (10);

resilient means (48) extending between the rim of said roof and said shoes to urge said shoes into contacting relation with the inner surface of the tank; and a flexible expansion joint (84) secured between the spaced ends of at least two of the shoes, said expansion joint including a flexible material (100) between adjacent shoes and manually operable means (95) for adjusting the width of said flexible material between said shoes (40) after said shoes (40) are placed against the inner peripheral surfaces (14) of said tank (10) to accommodate different spacings between different pairs of adjacent shoes, said flexible expansion joint (84) including a retaining bracket (86) secured to opposed adjacent sides of a pair of adjacent shoes; and said manually operable means (95) including mounting members (102) secured to opposite sides of said flexible material (100), said mounting members (102) and said flexible material (100) forming a manually removable unit (95) adapted for selective manual attachment to said retaining brackets (86) for connection of said adjacent shoes and for selective removal of said unit from said retaining brackets to separate said adjacent shoes.

2. In a cylindrical liquid storage tank (10) as set forth in claim 1;

said mounting member of said manually operable means including an elongate rod-like member extending in a generally vertical direction and mounted for rotation about a vertical axis, said flexible material (100) being secured to said rod-like member (102) whereby, upon rotation of said rod-like member (102) in one direction, any slack in said flexible material is removed.

3. In a cylindrical liquid storage tank (10) as set forth in claim 2;

said retaining bracket (86, 86A) including a vertically extending tubular member (92, 92A) secured to the side of said one of said adjacent shoes, said rod-like member (102, 102A) being removably mounted within said tubular members.

4. In a cylindrical liquid storage tank (10) as set forth in claim 1;

said cylindrical rim (22) of said roof (20) including a flange (34) along its upper edge; and hanger means (52) secured between each of said shoes (40) and said flange (34) to connect said shoes (40) to said roof (20) for vertical movement therewith upon changes in the level of the liquid (18) within the tank (10).

5. In a cylindrical liquid storage tank (10) as set forth in claim 4;

a fabric material (106) secured between said flange (34) of said roof (20) and the upper ends (44) of said shoes (40) to cover an annular space (36) between the roof (20) and the shoes (40).

6. In a cylindrical liquid storage tank (10) as set forth in claim 4;

each of said hanger means (52) including a first bracket (54) secured to said shoes (40) and an associated second bracket (58) secured to the adjacent roof (20), and adjustable rods, (74, 75) extending between said brackets for selectively adjusting the distance between said shoes and roof.

7. The cylindrical liquid storage tank as set forth in claim 6 wherein said flange (34) extends inwardly from said cylindrical rim (22).

8. In a cylindrical liquid storage tank (10) having a floating roof (20) with a cylindrical rim (22) thereabout; improved sealing means fitting between the circular rim of said roof and the inner peripheral surface (14) of said tank, said improved sealing means comprising:

a plurality of arcuate metal shoes (40) each having its side end (42) spaced from a side end (42) of an adjacent shoe, said shoes placed in a circular path in contact with the inner surface (14) of said tank (10);

resilient means (48) extending between the rim of said roof and said shoes to urge said shoes into contacting relation with the inner surface of the tank; and a flexible expansion joint (84) including a width of flexible material (100), said joint (84) adapted for selective manual placement between or removal from spaced ends (42) of at least two of said shoes (40) after said shoes are placed against the inner peripheral surface (14) of said tank (10), said joint (14) including means for manually adjusting (102, 104) said width of flexible material (100) dependent upon the space between said adjacent shoes (40) after said shoes have been installed against said inner peripheral surface.

* * * * *